US007556445B2

(12) United States Patent
Takahashi et al.

(10) Patent No.: US 7,556,445 B2
(45) Date of Patent: Jul. 7, 2009

(54) THERMAL ACTIVATION DEVICE AND METHOD OF CONVEYING SHEET MATERIAL

(75) Inventors: Masanori Takahashi, Chiba (JP); Tatsuya Obuchi, Chiba (JP); Yoshinori Sato, Chiba (JP); Minoru Hoshino, Chiba (JP); Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 520 days.

(21) Appl. No.: 11/137,842

(22) Filed: May 25, 2005

(65) Prior Publication Data

US 2005/0269026 A1 Dec. 8, 2005

(30) Foreign Application Priority Data

Jun. 1, 2004 (JP) ..... 2004-163090
Dec. 27, 2004 (JP) ..... 2004-376710

(51) Int. Cl.
*B41J 2/315* (2006.01)
*B41J 2/32* (2006.01)

(52) U.S. Cl. ..... 400/120.01; 400/120.14; 347/171; 347/177; 347/217

(58) Field of Classification Search ..... None
See application file for complete search history.

(56) References Cited

U.S. PATENT DOCUMENTS 4,834,277 A * 5/1989 Gomoll et al. ..... 226/101
6,162,316 A * 12/2000 Spitler et al. ..... 156/227
6,471,351 B1 * 10/2002 Ishikawa et al. ..... 347/104
7,173,642 B2 * 2/2007 Nureki ..... 347/187

FOREIGN PATENT DOCUMENTS

| | | | |
|---|---|---|---|
| EP | 1088672 | * | 4/2001 |
| EP | 1354715 | | 10/2003 |
| EP | 1393917 | | 3/2004 |
| JP | 63214465 | * | 3/1987 |
| JP | 62146859 | * | 6/1987 |

* cited by examiner

*Primary Examiner*—Daniel J Colilla
*Assistant Examiner*—Marissa L Ferguson-Samreth
(74) *Attorney, Agent, or Firm*—Adams & Wilks

(57) ABSTRACT

A thermal activation device has a thermal activation head that thermally activates a heat-sensitive adhesive layer of a sheet material having a printing layer on one surface of a sheet-like base material and the heat-sensitive adhesive layer formed on the other surface thereof. A platen roller conveys the sheet material and is disposed in pressure contact with the thermal activation head so that the platen roller and the thermal activation head apply a holding force on the sheet material. A pair of conveyor rollers hold and convey the sheet material and are disposed on a downstream side of the thermal activation head in a conveying direction of the sheet material. A holding force applied on the sheet material by the pair of conveyor rollers being larger than a holding force applied on the sheet material by the platen roller and the thermal activation head.

9 Claims, 6 Drawing Sheets

1 LABEL ISSUING INSTRUMENT

1 LABEL ISSUING INSTRUMENT

61b CONVEYOR ROLLER

THERMAL ACTIVATION DEVICE AND METHOD OF CONVEYING SHEET MATERIAL

BACKGROUND OF THE INVENTION

1. Field of the Invention

The present invention relates to a thermal activation device for thermally activating a heat-sensitive adhesive layer of a sheet material having a printing layer formed on one surface of a sheet-like base material and the heat-sensitive adhesive layer formed on the other surface thereof. The present invention also relates to a method of conveying the sheet material.

2. Description of the Related Art

For example, in distribution centers and shops, labels for displaying various types of information such as prices and for displaying barcodes for management by means of POS (point of sales) terminals have been used by being attached to articles. As this type of label, a proposal has been made of a label, which is issued using a sheet material having a printing layer formed on one surface of a sheet-like base material and a heat-sensitive adhesive layer formed on the other surface thereof.

In general, a label issuing instrument which issues the label having the heat-sensitive adhesive layer as described above includes a sheet supply apparatus that supplies the sheet material, a printing apparatus that prints various types of information on a thermal printing layer of the sheet material supplied from the sheet supply apparatus, a cutting apparatus that cuts the sheet material for which the printing has been performed by the printing apparatus, and a thermal activation device that thermally activates the heat-sensitive adhesive layer of the sheet material.

Moreover, as a conventional label issuing instrument including the thermal activation device, there is known a structure in which a guiding apparatus that sags and guides the sheet material is disposed between the cutting apparatus and the thermal activation device (for example, refer to. JP 2003-316265 A).

Incidentally the label issued from the sheet material having the heat-sensitive adhesive layer is sometimes used in such a manner that the entire surface of the heat-sensitive adhesive layer is not thermally activated evenly, but only a part thereof is thermally activated to form an adhesive region, and the other portions are left as a non-adhesive region which is not thermally activated.

In such a label, for example, one end side as the adhesive region of the label is attached to an article and the other end side as the non-adhesive region is not attached to the article. Moreover, in the label, for example, a tear-off line or the like is provided on a border between the adhesive region and the non-adhesive region, and in a distribution process of such articles, the other end side of the label is cut off and used as a slip for management.

As described above, in the conventional thermal activation device, when the heat-sensitive adhesive layer of the sheet material is thermally activated partially in the width direction perpendicular to the conveying direction of the sheet material, the adhesive region thermally activated by a thermal activation head and the non-adhesive region which is not thermally activated are unevenly present in the width direction of the sheet material.

As shown in FIG. 8, in a conventional thermal activation device 110, a heat-sensitive adhesive layer of a sheet material 103 held between a thermal activation head 111 and a platen roller 112 is thermally activated partially at a thermal activation position $P_2$ of the thermal activation head 111.

For example, with respect to a centerline C in a direction of a width $W_1$ perpendicular to the conveying direction of the sheet material 103 as a direction indicated by an arrow L, a region with a width $W_2$ from the centerline C to one end side is formed into an adhesive region 121, and a region with a width $W_2$ from the centerline C to the other end side is formed into a non-adhesive region 122. In this case, with respect to the centerline C of the sheet material 103 in the direction of the width $W_1$, a friction coefficient differs between the adhesive region 121 and the non-adhesive region 122.

Therefore, there is a problem in that, in the sheet material 103, the conveying speed of the adhesive region 121 becomes $v_1$, the conveying speed of the non-adhesive region 122 becomes $v_2$, and the conveying speed $v_1$ of the adhesive region 121 becomes larger than the conveying speed $v_2$ of the non-adhesive region 122, the conveying of the sheet material 103 being performed by the platen roller 112 which is brought into press contact with the sheet material 103.

As a result, a difference occurs between the respective conveying speeds $v_1$ and $v_2$ in the width direction by the platen roller 112, and thus there is a problem in that the sheet material 103 is inclined with respect to the conveying direction to cause skew feed.

Hence, in the conventional thermal activation device, the sheet material is inclined as described above, and thus the respective widths $W_2$ of the adhesive region 121 thermally activated by the thermal activation head 111 and the non-adhesive region 122 which is not thermally activated are changed. Accordingly, it has been difficult to form the adhesive region having an intended width on the heat-sensitive adhesive layer of the sheet material 103.

SUMMARY OF THE INVENTION

It is therefore an object of the present invention to provide a thermal activation device and a method of conveying a sheet material, which are capable of forming well the adhesive region and the non-adhesive region with desired widths without changing the widths by preventing the sheet material to be caused to skew feed in the case of thermally activating the heat sensitive adhesive layer asymmetrically with respect to the centerline of the sheet material in the width direction.

To attain the above-mentioned object of the invention, a thermal activation device of the present invention includes: heating means for thermally activating a heat-sensitive adhesive layer of the sheet material having a printing layer formed on one surface of a sheet-like base material and the heat-sensitive adhesive layer formed on the other surface thereof; a platen roller for holding and conveying the sheet material, the platen roller being brought into press contact with the heating means; and a pair of conveyor rollers that convey the sheet material, the conveyor rollers being provided on a conveyor route of the sheet material by the platen roller and the heating means, in which holding force for the sheet material applied by the pair of conveyor rollers is made larger than holding force for the sheet material applied by the platen roller and the heating means.

According to the thermal activation device of the present invention, which is constructed as described above, the holding force for the sheet material applied by the pair of conveyor rollers is made larger than the holding force for the sheet material applied by the platen roller and the heating means. Thus, in the case where the heating means thermally activates the heat-sensitive adhesive layer asymmetrically with respect to the centerline in the width direction perpendicular to the conveying direction of the sheet material, when a difference occurs in the conveying speed of the sheet material in the width direction, the conveying of the sheet material being performed by the platen roller by following a difference in frictional force occurring in the width direction of the sheet material, the pair of conveyor rollers impart tension to the sheet material to be conveyed. Thus, the sheet material is conveyed by taking conveying speed by the pair of conveyor rollers as a reference, irrespective of the difference in the conveying speed, which occurs in the width direction of the sheet material. Accordingly, the sheet material is restricted from being conveyed while being inclined with respect to the conveying direction.

Moreover, in the thermal activation device according to the present invention, the pair of conveyor rollers are provided to be located on an upstream side of the heating means in the conveying direction of the sheet material, and the holding force for the sheet material applied by the pair of conveyor rollers is made larger than the holding force for the sheet material applied by the platen roller and the heating means. Furthermore, in the case where the heating means thermally activates the heat-sensitive adhesive layer asymmetrically with respect to the centerline in the width direction perpendicular to the conveying direction of the sheet material, the conveying speed by the pair of conveyor rollers is made slower than the conveying speed by the platen roller. With this structure, the holding force for the sheet material applied by the pair of conveyor rollers is made larger than that applied by the platen roller and the heating means, and the conveying speed by the pair of conveyor rollers is made slower than the conveying speed by the platen roller. Thus, a difference occurs between the conveying speed of the sheet material by the pair of conveyor rollers and that of the sheet material by the platen roller and the heating means. Accordingly, the sheet material slips between the platen roller and the heating means, and is conveyed by taking the conveying speed by the pair of conveyor rollers of which conveying speed is slow as a reference. Hence, when the heating means thermally activates the heat-sensitive adhesive layer asymmetrically with respect to the centerline in the width direction perpendicular to the conveying direction of the sheet material, the sheet material is conveyed by taking the conveying speed by the pair of conveyor rollers as a reference, irrespective of the difference occurring in the conveying speed in the width direction, the conveying being performed by the platen roller by following the difference in frictional force occurring in the width direction of the sheet material. Accordingly, the sheet material is restricted from being conveyed while being inclined with respect to the conveying direction.

Moreover, in the thermal activation device according to the present invention, the pair of conveyor rollers are provided to be located on a downstream side of the heating means in the conveying direction of the sheet material, and the holding force for the sheet material applied by the platen roller and the heating means is made smaller than that applied by the pair of conveyor rollers. With this structure, the conveying of the sheet material by the platen roller and the heating means is limited and restricted, and the sheet material is conveyed by the pair of conveyor rollers in which the holding force is made relatively large. Hence, when the heating means thermally activates the heat-sensitive adhesive layer asymmetrically with respect to the centerline in the width direction perpendicular to the conveying direction of the sheet material, the sheet material is conveyed by taking the conveying speed by the pair of conveyor rollers as a reference irrespective of the difference occurring in the conveying speed in the width direction, the conveying being performed by the platen roller, following the difference in frictional force occurring in the width direction of the sheet material. Accordingly, the sheet material is restricted from being conveyed while being inclined with respect to the conveying direction.

Furthermore, the thermal activation device according to the present invention may further include drive force shielding means for shielding a rotational drive force of the platen roller in response to the tension of the sheet material held between the pair of conveyor rollers and a set of the platen roller and the heating means. In such away, when the sheet material is conveyed by taking the conveying speed by the pair of conveyor rollers as a reference, the sheet material is prevented from being damaged by being loaded with excessive tension between the pair of conveyor rollers and the set of the platen roller and the heating means.

Moreover, in the thermal activation device according to the present invention, one of the pair of conveyor rollers, which is brought into contact with the heat-sensitive adhesive layer, may include plural annular members which are arranged at an interval in an axial direction of a rotation shaft and convey the sheet material. In such a way, when the sheet material is conveyed by the pair of conveyor rollers while being brought into press contact therewith, the heat-sensitive adhesive layer having adhesiveness by being thermally activated by the heating means is restricted from being adhered onto a peripheral surface of the conveyor roller, and the sheet material is restricted from being wound around the peripheral surface. Hence, reliability of the pair of conveyor rollers in the conveying operation for the sheet material is enhanced.

Furthermore, in the annular members in the thermal activation device according to the present invention, projections and depressions may be formed on a peripheral surface thereof abutting on the heat-sensitive adhesive layer. In such a way, an area of the conveyor roller, which abuts on the heat-sensitive adhesive layer of the sheet material, is made small, the holding force for the sheet material is made large, and thus slippage between the conveyor roller and the sheet material is restricted from occurring. Hence, in the conveyer rollers, accuracy in conveyor stroke of the sheet material is enhanced, and it is made possible to restrict the sheet material from being inclined to a further small extent.

The present invention is also directed to a printer having the thermal activation device according to any one of the foregoing embodiments, and a printing apparatus that performs printing for the printing layer by heating the print layer, wherein the sheet material is conveyed to pass through the thermal activation device and the printing apparatus.

In another aspect, the invention is directed to a method of conveying a sheet material by using a thermal activation device that includes heating means for thermally activating a heat-sensitive adhesive layer of the sheet material having a printing layer formed on one surface of a sheet-like base material and the heat-sensitive adhesive layer formed on the other surface thereof; a platen roller for holding and conveying the sheet material, the platen roller being brought into press contact with the heating means; and a pair of conveyor rollers that convey the sheet material, the conveyor rollers being provided on a conveyor route of the sheet material by the platen roller and the heating means, wherein holding force for the sheet material applied by the pair of conveyor rollers is made larger than holding force for the sheet material applied by the platen roller and the heating means.

As described above, according to the thermal activation device and the method of conveying a sheet material in accordance with the present invention, the sheet material is conveyed by taking, as a reference, the conveying speed by the pair of conveyor rollers provided on the conveyor route of the sheet material by the platen roller and the heating means.

Accordingly, the sheet material can be prevented from being conveyed while being inclined with respect to the conveying direction thereof owing to the difference in frictional force occurring in the width direction of the sheet material. Hence, according to the present invention, even in the case of thermally activating the heat-sensitive adhesive layer asymmetrically with respect to the centerline of the sheet material in the width direction, the sheet material is prevented from being inclined. Accordingly, the adhesive region and the non-adhesive region can be formed well with the desired widths on the heat-sensitive adhesive layer of the sheet material.

DETAILED DESCRIPTION OF THE PREFERRED EMBODIMENTS

Specific embodiments of the present invention will be described below with reference to the drawings.

First, a label issuing instrument to be used in the case of issuing a label attached to an article for displaying various types of information on the article will be briefly described.

Figure 1:
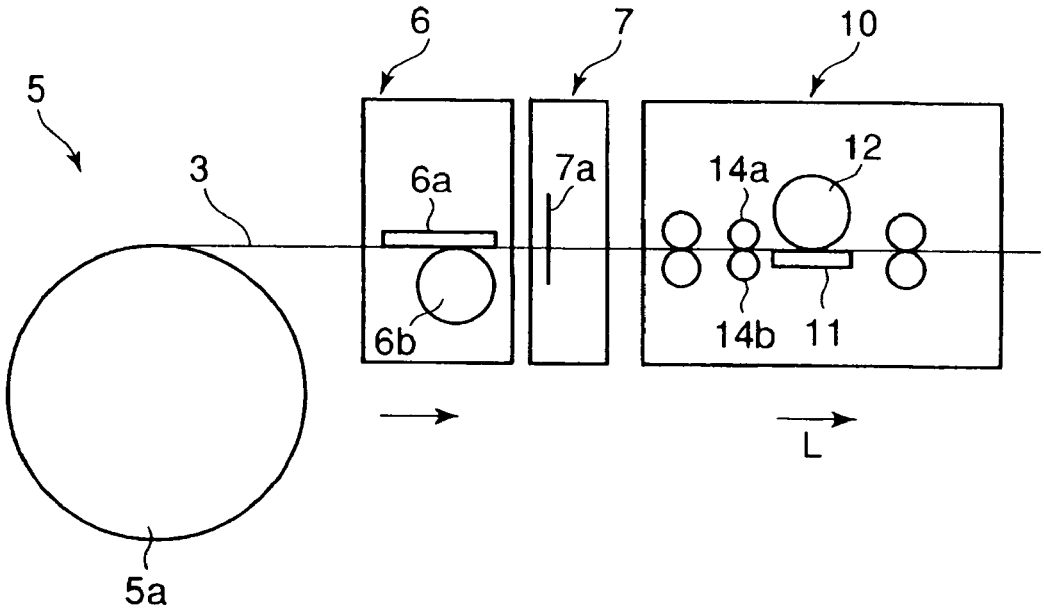
FIG. 1 is a cross-sectional view schematically showing a label issuing apparatus including a thermal activation device according to the present invention.

As shown in FIG. 1, in a label issuing instrument 1, a sheet supply apparatus 5 that supplies a sheet material 3, a printing apparatus 6 that prints various types of information on a thermal printing layer of the sheet material 3, a cutting apparatus 7 that cuts the sheet material 3 for which the printing has been performed by the printing apparatus 6, and a thermal activation device 10 that thermally activates a heat-sensitive adhesive layer of the sheet material 3 are arranged in the stated order along a conveyor route of the sheet material 3 in the direction indicated by an arrow L in FIG. 1.

The sheet supply apparatus 5 includes a sheet roll 5*a* around which the sheet material 3 is wound, and supplies the sheet material 3 from the sheet roll 5*a* in an unreeling way. Although not shown, the sheet material 3 supplied from the sheet supply apparatus 5 includes a sheet-like base material, the thermal printing layer formed on a surface side of the sheet-like base material, and the heat-sensitive adhesive layer provided on a back surface side of the sheet-like base material. Note that, according to needs, as the sheet material, used may be one having a configuration in which a heat-insulating layer for shielding heat conduction from one-side layer of the sheet-like base material to the other-side layer thereof is provided between the sheet-like base material and the thermal printing layer.

A so-called thermal printer is used as the printing apparatus 6, and the printing apparatus 6 includes a thermal head 6*a* for making the thermal printing layer of the sheet material 3 heat-sensitive, and a platen roller 6*b* brought into press contact with the thermal head 6*a*. While sandwiching the sheet material 3 supplied from the sheet supply apparatus 5 between the thermal head 6*a* and the platen roller 6*b*, the printing apparatus 6 performs printing for the sheet material 3, and conveys the sheet material 3 concerned. Note that the printing apparatus 6 may be disposed on a downstream side of the thermal activation device 10 in the conveying direction of the sheet material 3 according to needs. The cutting apparatus 7 includes a cutter 7*a* for cutting the sheet material 3 discharged from the printing apparatus 6 into a desired length, and conveys the sheet material 3 thus cut to the thermal activation device 10.

Figure 2:
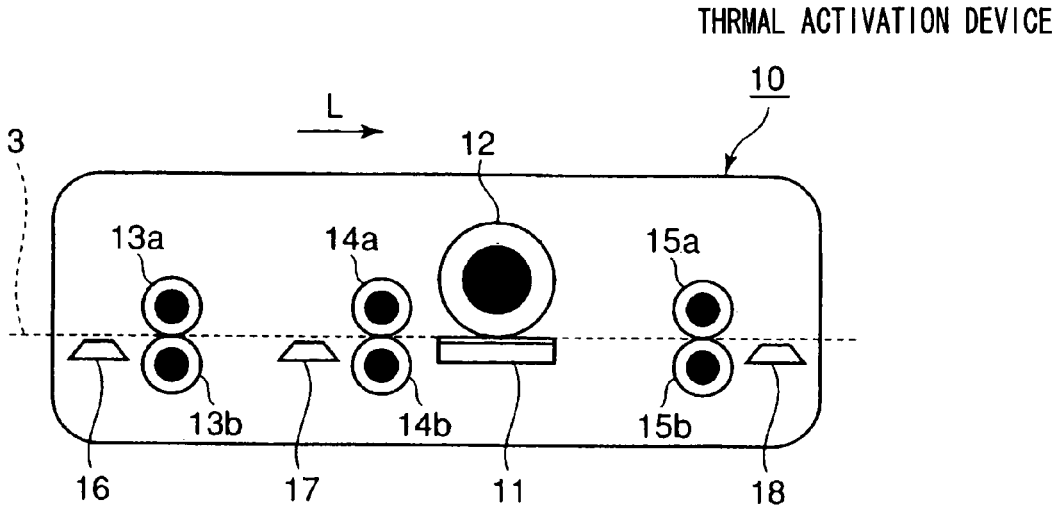
FIG. 2 is a cross-sectional view schematically showing the thermal activation device.

As shown in FIG. 2, the thermal activation device 10 includes a thermal activation head 11 for thermally activating the heat-sensitive adhesive layer of the sheet material 3, a platen roller 12 which is brought into press contact with the thermal activation head 11 and conveys the sheet material 3 in the conveying direction as the direction indicated by the arrow L while sandwiching the sheet material 3 between the platen roller 12 itself and the thermal activation head 11, a pair of feed-in rollers 13*a* and 13*b* for feeding the sheet material 3 conveyed from the cutting apparatus 7 into the thermal activation device 10, a pair of conveyor rollers 14*a* and 14*b* for conveying the sheet material 3 fed in by the feed-in rollers 13*a* and 13*b* to the thermal activation head 11 and the platen roller 12 side, and a pair of discharge rollers 15*a* and 15*b* for discharging the sheet material 3 thermally activated by the thermal activation head 11 to the outside of the thermal activation device 10.

Figure 3:
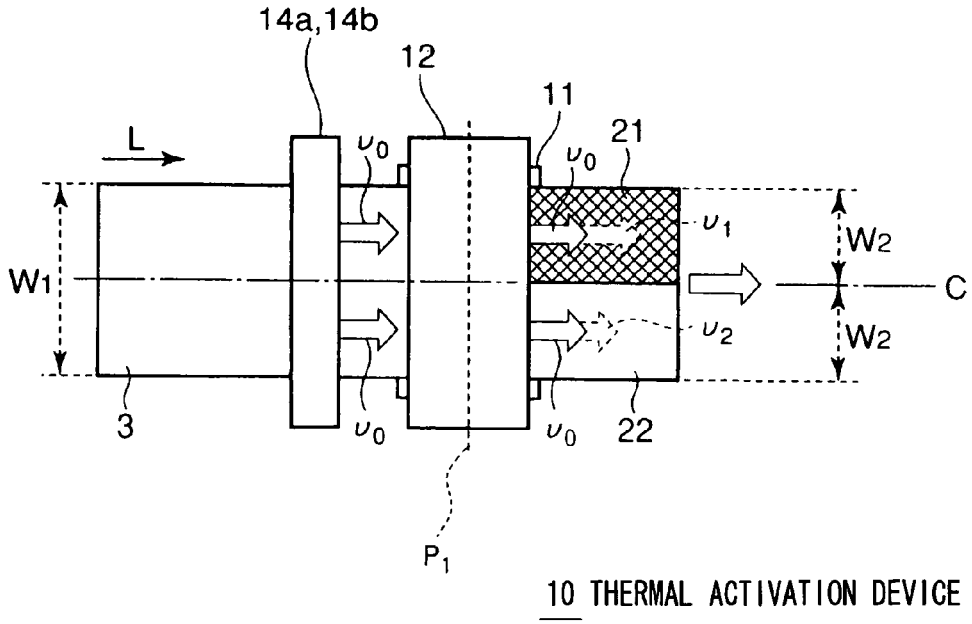
FIG. 3 is a plan view schematically showing the thermal activation device.

One similar to the thermal head 6*a* provided in the printing apparatus 6 is used as the thermal activation head 11. As shown in FIG. 3, plural heating elements (not shown) are arranged along a direction of a width $W_1$ perpendicular to the conveying direction of the sheet material 3. The thermal activation head 11 selectively heats arbitrary heating elements, thus making it possible to thermally activate the heat-sensitive adhesive layer per dot unit in the direction of the width $W_1$ of the sheet material 3. Moreover, the thermal activation head 11 is brought into press contact with a peripheral surface of the platen roller 12 by elastic force due to a compression coil spring (not shown).

Moreover, as shown in FIG. 3, the thermal activation head 11 thermally activates the heat-sensitive adhesive layer selectively in the direction of the width $W_1$ of the sheet material 3 at a thermal activation position $P_1$. With respect to a centerline C in the direction of the width $W_1$, a region with a width $W_2$ from the centerline C to one end side is formed into an adhesive region 21, and a region with a width $W_2$ from the centerline C to the other end side is formed into a non-adhesive region 22. Specifically, the heat-sensitive adhesive layer of the sheet material 3 is thermally activated asymmetrically with respect to the centerline C in the direction of the width $W_1$ by the thermal activation head 11. In other words, the adhesive region 21 is unevenly formed in the direction of the width $W_1$.

The conveyor rollers 14*a* and 14*b* are located on an upstream side of the thermal activation head 11 in the conveying direction of the sheet material 3, and are provided at a position adjacent to the thermal activation head 11 and the platen roller 12. The conveyor rollers 14*a* and 14*b* are rotationally driven in a manner that one is rotationally driven and the other is thus rotationally driven following the one.

Moreover, friction coefficients of the pair of conveyor rollers 14*a* and 14*b* and press contact force thereof to the sheet material 3 are set so that holding force for the sheet material 3 by the conveyor rollers 14*a* and 14*b* is made larger than holding force for the sheet material 3 by the platen roller 12 and the thermal activation head 11. Furthermore, conveying speed by the conveyor rollers 14*a* and 14*b* of which diameters are made smaller that that of the platen roller 12 is made slower than conveying speed by the platen roller 12. Note that holding force for the sheet material 3 by the pair of discharge rollers 15*a* and 15*b* is smaller than the holding force by the platen roller 12 and the thermal activation head 11, and is set to an extent of guiding the discharge of the sheet material 3.

Therefore, when the sheet material 3 is conveyed, the sheet material 3 held to bridge between the conveyor rollers 14*a* and 14*b* and the platen roller 12 brought into press contact with the thermal activation head 11 slips between the thermal activation head 11 and the platen roller 12, and the sheet material 3 is conveyed by taking, as a reference, the conveying speed by the conveyor rollers 14*a* and 14*b* of which conveying speed is slow.

When being conveyed as described above, the sheet material 3 slips between the conveyor rollers 14*a* and 14*b* and the platen roller 12 brought into press contact with the thermal activation head 11, and is conveyed in a state of being pulled with predetermined tension in the conveying direction.

Moreover, rotation speed of the platen roller 12 is set so that the sheet material 3 slips over the entire width of the peripheral surface of the platen roller 12. Specifically, a difference in conveying speed between the conveyor rollers 14*a* and 14*b* and the platen roller 12 is set to an extent where the condition described above is maintained.

Furthermore, the sheet material 3 is to be conveyed at the conveying speed by the conveyor rollers 14*a* and 14*b*. Note that the conveying speed of the sheet material 3 by the conveyor rollers 14*a* and 14*b*, that is, the discharge speed, is set at, for example, approximately 50 to 200 mm/s.

As shown in FIG. 3, in the case where the heat-sensitive adhesive layer of the sheet material 3 is thermally activated asymmetrically with respect to the centerline C in the direction of the width $W_1$, as described in the description of the related art, a friction coefficient differs between the adhesive region 21 and the non-adhesive region 22. Therefore, a difference occurs between conveying speed $v_1$ of the adhesive region 21 by the platen roller 12 and conveying speed $v_2$ of the non-adhesive region 22 by the platen roller 12, and the sheet material 3 has been conveyed while being inclined in the conveying direction.

However, in the thermal activation device 10 according to the present invention, the sheet material 3 is conveyed by taking, as a reference, conveying speed $v_0$ of the sheet material 3 by the conveyor rollers 14*a* and 14*b* provided on an upstream side of the platen roller 12 in the conveying direction. Accordingly, the conveying speed by the platen roller 12 also becomes $v_0$, and the conveying speed of the sheet material 3 by the platen roller 12 in the direction of the width $W_1$ is equalized between the adhesive region 21 and the non-adhesive region 22.

Therefore, even if the heat-sensitive adhesive layer is thermally activated unevenly in the direction of the width $W_1$, the sheet material 3 is prevented from being conveyed while being inclined. Hence, the thermal activation device 10 can form well the adhesive region 21 and non-adhesive region 22 of the sheet material 3 with desired widths without changing the widths $W_2$ therebetween by means of the thermal activation head 11.

Meanwhile, a configuration may also be adopted so that conveying force by the platen roller 12 can be released in response to a magnitude of the tension loaded on the sheet material 3 held between the pair of conveyor rollers 14*a* and 14*b* and a set of the platen roller 12 and the thermal activation head 11, following the difference between the conveying speed of the sheet material 3 by the conveyor rollers 14*a* and 14*b* and the conveying speed of the sheet material 3 by the platen roller 12. In the case of such a configuration, the thermal activation device 10 includes, for example, a clutch (not shown) that is drive force shielding means for shielding a rotational drive force of the platen roller 12. In such a way, when predetermined tension or more is loaded on the sheet material 3, the conveying force by the platen roller 12 is released, thus making it possible to prevent the sheet material 3 from being damaged.

Moreover, as shown in FIG. 2, the thermal activation device 10 includes a first sensor 16 for detecting that the sheet material 3 has reached the feed-in rollers 13*a* and 13*b*, a second sensor 17 for detecting that the sheet material 3 has reached the conveyor rollers 14*a* and 14*b*, and a third sensor 18 for detecting that the sheet material 3 has reached the discharge rollers 15*a* and 15*b*.

The first sensor 16 is disposed on an upstream side of the feed-in rollers 13*a* and 13*b* in the conveying direction of the sheet material 3. The second sensor 17 is disposed on an upstream side of the conveyor rollers 14*a* and 14*b* in the conveying direction of the sheet material 3. The third sensor 18 is disposed on a down stream side of the discharge rollers 15*a* and 15*b* in the conveying direction of the sheet material 3. For example, each of the first, second and third sensors 16, 17 and 18 includes a light-emitting element that emits detection light, and a light-receiving element that receives the detection light, both of which are arranged at positions opposite to each other with a conveyor router of the sheet material 3 interposed therebetween. Each of the first, second and third sensors 16, 17 and 18 is structured so as to detect the presence of the sheet material 3 based on a behavior that the detection light is shielded by the sheet material 3.

Figure 4:
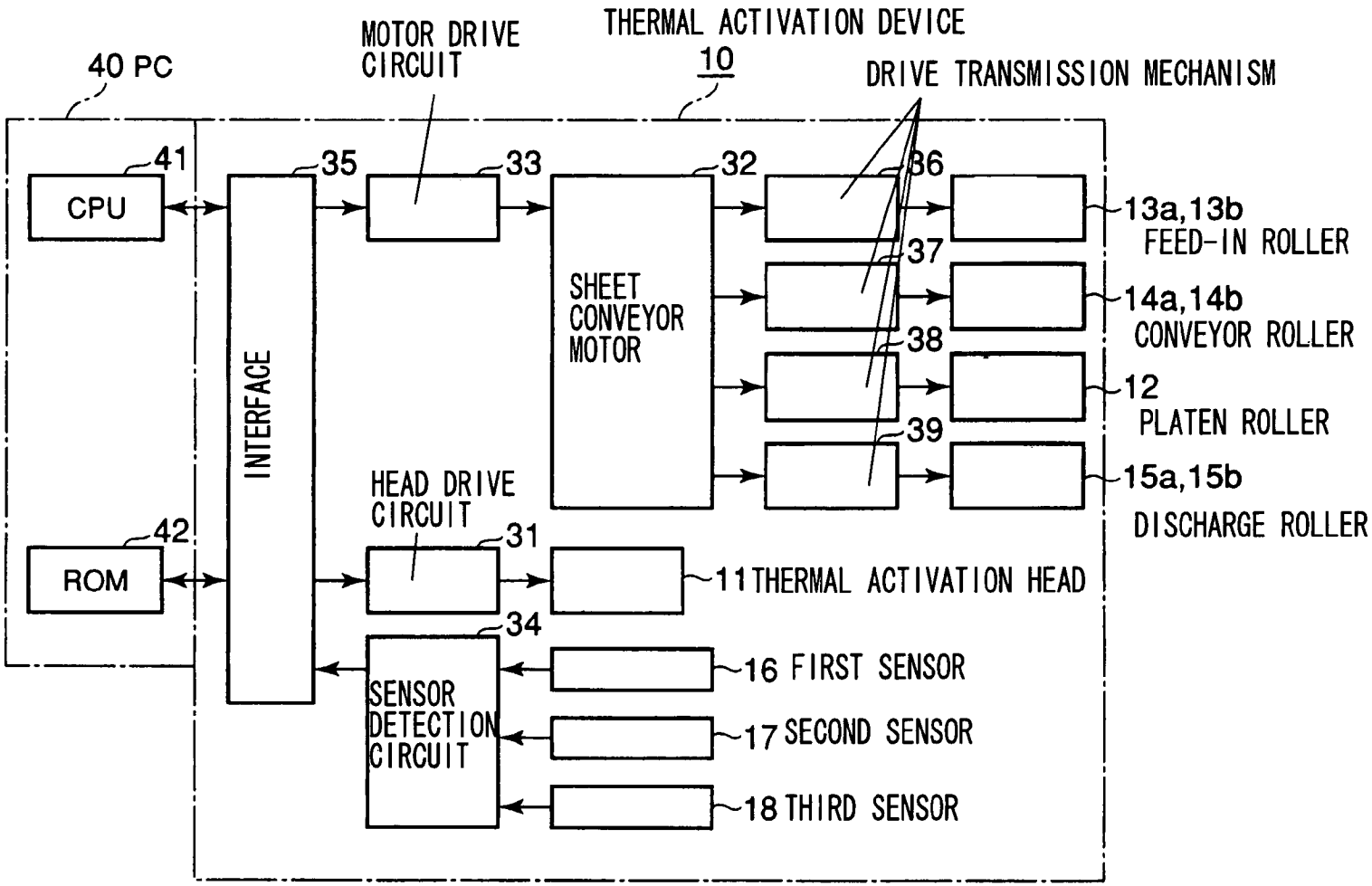
FIG. 4 is a block diagram for explaining the thermal activation device.

Moreover, for the purpose of controlling a thermal activation operation for the sheet material 3, as shown in FIG. 4, the thermal activation device 10 includes a head drive circuit 31 that drives and controls the thermal activation head 11, a sheet conveyor motor 32 for rotationally driving the feed-in rollers 13*a* and 13*b*, the conveyor rollers 14*a* and 14*b*, the platen roller 12 and the discharge rollers 15*a* and 15*b* individually, a motor drive circuit 33 that drives and controls the sheet convey or motor 32, and a sensor detection circuit 34 to which states detected by the first, second and third sensors 16, 17 and 18 are individually inputted.

The head drive circuit 31, the motor drive circuit 33, and the sensor detection circuit 34, which are described above, are electrically connected to an interface 35 individually. The sheet conveyor motor 32 transmits drive force through drive transmission mechanisms 36, 37, 38 and 39 having unillustrated gear arrays, and rotationally drives the respective feed-in rollers 13*a* and 13*b*, conveyor rollers 14*a* and 14*b*, platen roller 12, and discharge rollers 15*a* and 15*b*. Note that, though not shown, the respective feed-in rollers 13*a* and 13*b*, conveyor rollers 14*a* and 14*b*, platen roller 12, and discharge rollers 15*a* and 15*b* may also be configured so as to be rotationally driven by the respective motors provided therefor independently of one another.

Moreover, the thermal activation device 10 is electrically connected to an external electrical instrument, for example, such as a PC (personal computer) 40 through the interface 35. The PC 40 includes a CPU (central processing unit) 41, a ROM (read-only memory) 42 in which a program for a thermal activation treatment is stored, and the like, and drives and controls the thermal activation device 10.

With regard to the thermal activation device 10 configured as described above, an operation in the case of thermally activating the heat-sensitive adhesive layer of the sheet material 3 and conveying the sheet material 3 will be described with reference to the drawing.

Figure 5:
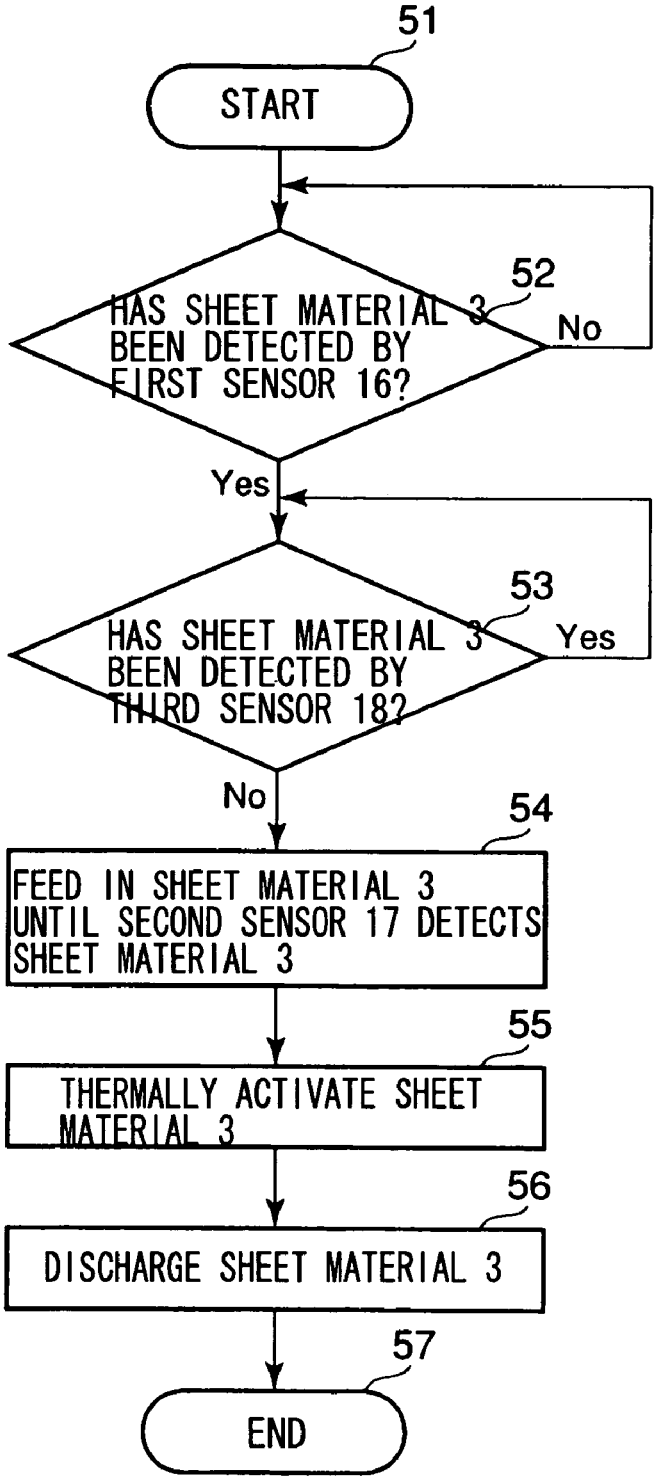
FIG. 5 is a flowchart for explaining an operation of thermally activating a sheet material.

First, as shown in FIG. 5, the thermal activation operation for the sheet material 3 is started from Step 51, and the presence of the sheet material 3 is detected by the first sensor 16 (Step 52). In the case where the presence of the sheet material 3 has been detected by the first sensor 16, the operation proceeds to Step 53, where the presence of the sheet material 3 is detected by the third sensor 18. Meanwhile, in the case where the presence of the sheet material 3 has not been detected by the first sensor 16, the operation returns to Step 52. In the case where the presence of the sheet material 3 has not been detected by the third sensor 18, the operation proceeds to Step 54. Meanwhile, in the case where the presence of the sheet material 3 has not been detected by the third sensor 18, the operation returns to Step 53.

Next, the sheet material 3 is conveyed by the feed-in rollers 13*a* and 13*b* until the presence of the sheet material 3 is detected by the second sensor 17. After the sheet material 3 has been detected by the second sensor 17, the heat-sensitive adhesive layer of the sheet material 3 is thermally activated by the conveyor rollers 14*a* and 14*b*, the platen roller 12, and the thermal activation head 11 (Step 55). Subsequently, the discharge rollers 15*a* and 15*b* are rotationally driven, and thus the thermally activated sheet material 3 is discharged as a label to the outside of the thermal activation device 10 (Step 56), before the thermal activation operation is completed (Step 57).

As described above, according to the thermal activation device 10, the pair of conveyor rollers 14*a* and 14*b* are provided to be located on the upstream side of the thermal activation head 11 and the platen roller 12 in the conveying direction of the sheet material 3, and the conveying speed of the sheet material 3 by the conveyor rollers 14*a* and 14*b* is made slower than the conveying speed of the sheet material 3 by the platen roller 12. Thus, even in the case where the heat-sensitive adhesive layer is thermally activated asymmetrically with respect to the centerline of the sheet material 3 in the width direction, the sheet material 3 can be prevented from being conveyed by the platen roller 12 while being inclined.

Hence, according to the thermal activation device 10, the adhesive region 21 and the non-adhesive region 22 can be formed well with the respective widths $W_2$ on the heat-sensitive adhesive layer of the sheet material 3 by the thermal activation head 11.

In the thermal activation device 10 of the above-described embodiment, a configuration is adopted, in which the pair of conveyor rollers 14*a* and 14*b* are disposed on the upstream side of the thermal activation head 11 in the conveying direction of the sheet material 3. Now, another embodiment will be described, in which the pair of conveyor rollers are disposed on the downstream side of the thermal activation head in the conveying direction. Note that, in a thermal activation device of another embodiment, the same reference numerals are assigned to the same members as those of the above-described embodiment, and description thereof will be omitted.

Figure 6:
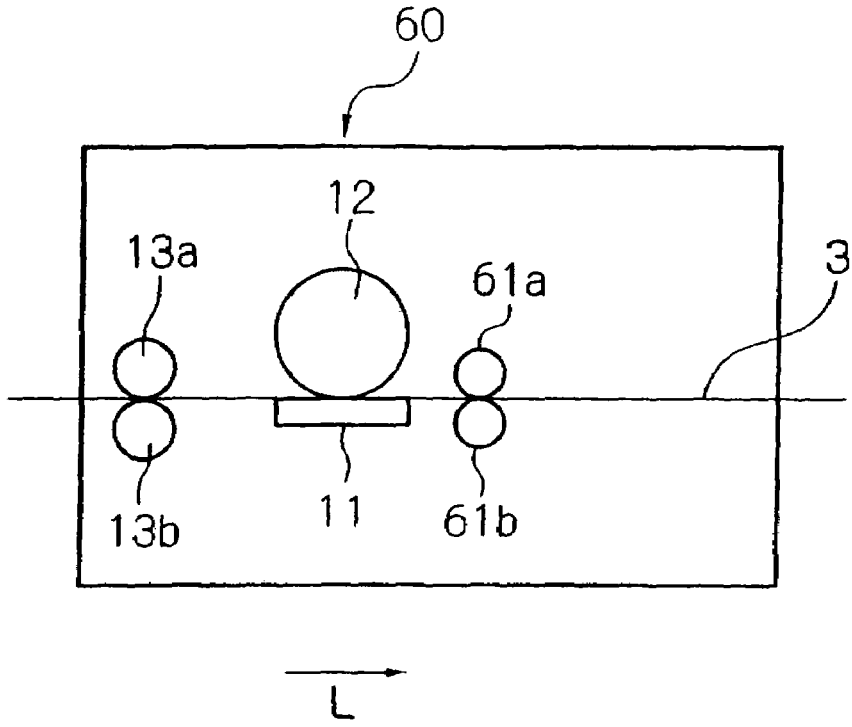
FIG. 6 is a cross-sectional view schematically showing a thermal activation device of another embodiment.

As shown in FIG. 6, a thermal activation device 60 includes a pair of conveyor rollers 61*a* and 61*b* for conveying the sheet material 3 thermally activated by the thermal activation head 11.

The pair of conveyor rollers 61*a* and 61*b* are located on a downstream side of the thermal activation head 11 in the conveying direction of the sheet material 3, and are provided at a position adjacent to the thermal activation head 11 and the platen roller 12. The conveyor rollers 61*a* and 61*b* are rotationally driven in a manner that one is rotationally driven and the other is thus rotationally driven following the one. Moreover, conveying speed by the pair of conveyor rollers 61*a* and 61*b* is set equal to the conveying speed by the platen roller 12 and the thermal activation head 11.

Moreover, a friction coefficient of the peripheral surface of the platen roller 12 and press contact force thereof to the sheet material 3 are set so that the holding force for the sheet material 3 by the platen roller 12 and the thermal activation head 11 can be made smaller than holding force for the sheet material 3 by the pair of conveyor rollers 61*a* and 61*b*. In other words, the holding force for the sheet material 3 by the pair of conveyor rollers 61 and 61*b* is made larger than the holding force for the sheet material 3 by the platen roller 12 and the thermal activation head 11.

Therefore, in the case where the thermal activation head 11 thermally activates the heat-sensitive adhesive layer asymmetrically with respect to the centerline in the width direction perpendicular to the conveying direction of the sheet material 3, when a difference occurs in conveying speed in the width direction by the platen roller 12, following the difference in frictional force occurring in the width direction of the sheet material 3, the sheet material 3 held to bridge between the conveyor rollers 61*a* and 61*b* and the platen roller 12 brought into press contact with the thermal activation head 11 is forcibly pulled by the conveyor rollers 61*a* and 61*b* of which holding force is large, and predetermined tension is imparted thereto. Specifically, the non-adhesive region 22 in which the conveying speed of the sheet material 3 by the platen roller 12 and the thermal activation head 11 slows down is forcibly pulled by the conveyor rollers 61*a* and 61*b*. Thus, the conveying speed of the non-adhesive region 22 is approximated to the conveying speed on the adhesive region 21 side, and the sheet material 3 is conveyed by taking, as a reference, the conveying speed by the conveyor rollers 61*a* and 61*b* of which holding force is large.

Figure 7:
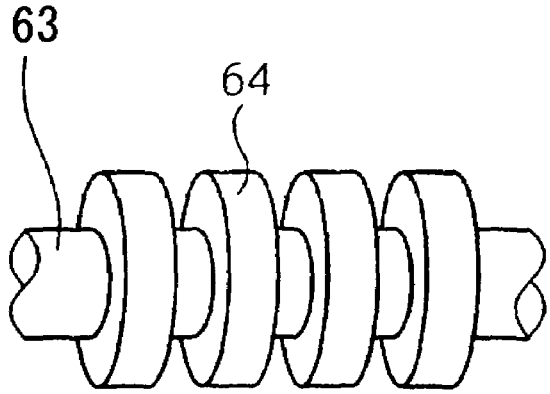
FIG. 7 is a schematic view showing an example of a conveyor roller.
Figure 8:
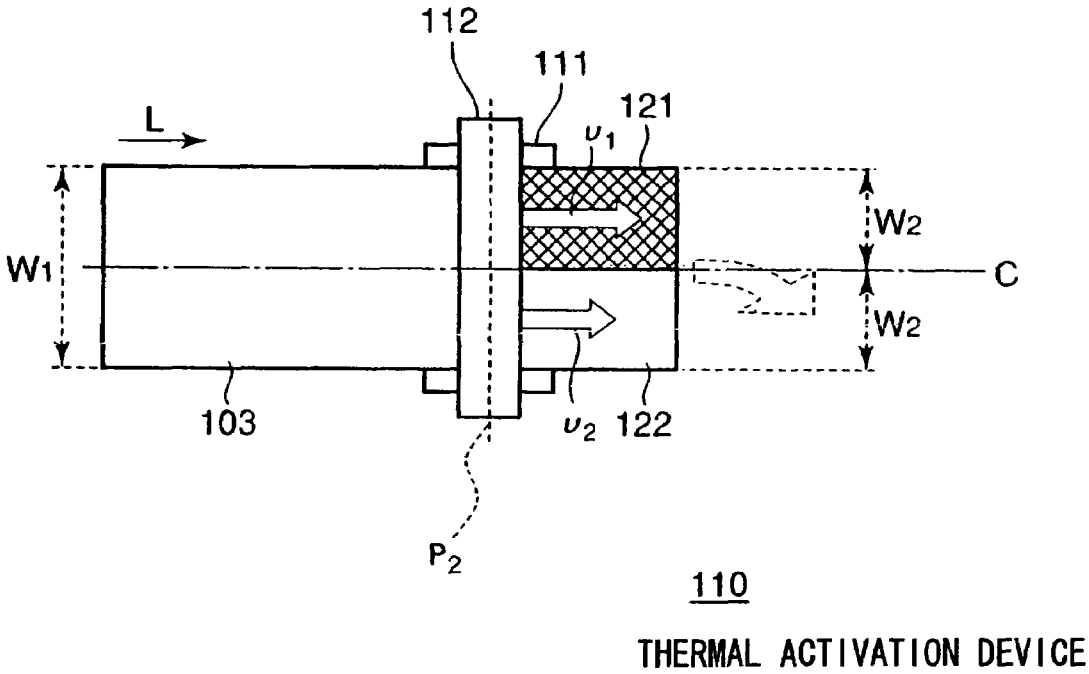
FIG. 8 PRIOR ART
FIG. 8 is a plan view schematically showing a conventional thermal activation device.

Moreover, as shown in FIG. 7, the conveyor roller 61*b* that is one of the pair, which is brought into contact with the heat-sensitive adhesive layer of the sheet material 3, includes a rotation shaft 63 rotationally driven by an unillustrated drive mechanism, and plural annular members 64 arranged at a predetermined interval in the axial direction of the rotation shaft 63. The conveyor roller 61*a* that is the other of the pair is formed into a cylindrical shape.

For example, the annular members 64 are formed of an elastic material such as rubber, and for example, O-rings are used. The respective annular members 64 are engaged with support grooves (not shown) provided around the rotation shaft 63.

The plural annular members 64 are made to abut on the sheet material 3, and the sheet material 3 is conveyed. Thus, with regard to the conveyor roller 61*b*, an area thereof made to abut on the heat-sensitive adhesive layer of the sheet material 3 is reduced. In such a way, in the case where the sheet material 3 is conveyed by the pair of conveyor rollers 61*a* and 61*b* while being brought into press contact therewith, the heat-sensitive adhesive layer having adhesiveness by being thermally activated by the thermal activation head 11 is restricted from being adhered onto the peripheral surface of the conveyor roller 61*b*, and the sheet material 3 is restricted from being wound around the peripheral surface. Hence, reliability of the pair of conveyor rollers 61*a* and 61*b* in the conveying operation for the sheet material 3 is enhanced.

Moreover, it is preferable that relatively fine projections and depressions such as knurls be formed on the peripheral surfaces of the annular members 64. Since the annular members 64 have the projections and the depressions formed on the peripheral surfaces thereof, an area thereof abutting on the heat-sensitive adhesive layer of the sheet material 3 is made small, and holding force thereof for the sheet material 3 is made large, thus restricting slippage between the convey or roller 61*b* and the sheet material 3 from occurring. Hence, accuracy in conveyor capacity of the sheet material 3 of the conveyer rollers 61*a* and 61*b* is enhanced, and it is made possible to restrict the sheet material 3 from being inclined to a further small extent.

Furthermore, though not shown, the annular members may also be looped over the rotation shaft rotationally driven and a driven shaft driven following rotation of the rotation shaft, and be formed into a belt shape. According to the annular members as described above, the annular members will be rotated while tension thereof is varying between the rotation shaft and the driven shaft. Accordingly, the heat-sensitive adhesive layer is restricted from being adhered onto the peripheral surface of the conveyor roller 61*b*, and the sheet material 3 is restricted from being wound around the peripheral surface.

According to the above-described thermal activation device 60, the pair of conveyor rollers 61*a* and 61*b* are provided at the position on the downstream side of the thermal activation head 11 in the conveying direction of the sheet material 3, and the holding force for the sheet material 3 by the platen roller 12 and the thermal activation head 11 is made smaller than the holding force for the sheet material 3 by the pair of conveyor rollers 61*a* and 61*b*. Thus, even in the case where the heat-sensitive adhesive layer is thermally activated asymmetrically with respect to the centerline of the sheet material 3 in the width direction, the sheet material 3 can be prevented from being conveyed while being inclined by the platen roller 12.

In the thermal activation device of each of the above-described embodiments, mentioned has been an example of the case of conveying the sheet material having the adhesive region and the non-adhesive region on the heat-sensitive adhesive layer. However, the present invention is suitable for application to the case of conveying a sheet material in which a friction coefficient is made uneven in the width direction of the sheet material according to needs such as pasting a label to an article so as to make it possible to easily peel off the label therefrom. For example, the above-described case includes the case of conveying a sheet material having a strong adhesive region and a weak adhesive region, in which extents of adhesiveness are different from each other, by differentiating a ratio of the adhesive region per dot unit.

Moreover, though the sheet material having the thermal printing layer has been adopted in the thermal activation device of the above-described embodiments, it is a matter of course that another sheet material having, for example, a pressure-sensitive printing layer and the like may be used.

What is claimed is:

1. A thermal activation device comprising:

heating means for thermally activating a heat-sensitive adhesive layer of a sheet material having a printing layer on one surface of a sheet-like base material and the heat-sensitive adhesive layer on the other surface thereof;

a platen roller that conveys the sheet material, the platen roller being disposed in pressure contact with the heating means so that the platen roller and the heating means apply a holding force on the sheet material;

a pair of conveyor rollers that hold and convey the sheet material, the pair of conveyor rollers being disposed on an upstream side of the heating means in a conveying direction of the sheet material and applying a holding force on the sheet material larger than the holding force applied on the sheet material by the platen roller and the heating means; and drive force shielding means for shielding a rotational drive force of the platen roller in response to a tension applied to the sheet material held between the pair of conveyor rollers and between the platen roller and the heating means;

wherein when the heating means thermally activates the heat-sensitive adhesive layer asymmetrically with respect to a centerline in a width direction perpendicular to the conveying direction of the sheet material, a conveying speed of the sheet material conveyed by the pair of conveyor rollers is slower than a conveying speed of the sheet material conveyed by the platen roller.

2. A thermal activation device according to claim 1; wherein the pair of conveyor rollers are disposed at a position adjacent to the heating means.

3. A thermal activation device according to claim 1; wherein the heating means comprises a thermal head.

4. A thermal activation device according to claim 1; further comprising a pair of feed-in rollers that feed the sheet material into the pair of conveyor rollers, the feed-in rollers being disposed on an upstream side of the pair of conveyor rollers in the conveying direction of the sheet material.

5. A thermal activation device according to claim 4; further comprising discharge rollers that discharge the sheet material after the heat-sensitive adhesive layer is thermally activated by the heating means, the discharge rollers being disposed on a downstream side of the heating means in the conveying direction of the sheet material.

6. A thermal activation device according to claim 1; further comprising detecting means for detecting the sheet material, the detecting means being disposed on the upstream side of the pair of conveyor rollers.

7. A method of conveying a sheet material, comprising:

providing a thermal activation device comprised of heating means for thermally activating a heat-sensitive adhesive layer of a sheet material having a printing layer on one surface of a sheet-like base material and the heat-sensitive adhesive layer on the other surface thereof, a platen roller that conveys the sheet material, the platen roller being disposed in pressure contact with the heating means so that the platen roller and the heating means apply a holding force on the sheet material, and a pair of conveyor rollers that hold and convey the sheet material, the pair of conveyor rollers being disposed on an upstream side of the heating means in a conveying direction of the sheet material and applying a holding force on the sheet material larger than a holding force applied on the sheet material by the platen roller and the heating means;

thermally activating with the heating means the heat-sensitive adhesive layer of the sheet material asymmetrically with respect to a centerline in a width direction perpendicular to the conveying direction of the sheet material; and conveying the sheet material by the conveyor rollers and the platen roller while thermally activating the heat-sensitive adhesive layer so that a conveying speed of the sheet material conveyed by the pair of conveyor rollers is slower than a conveying speed of the sheet material conveyed by the platen roller.

8. A method of conveying a sheet material according to claim 7; further comprising shielding a rotation drive force of the platen roller in response to tension of the sheet material held between the pair of conveyor rollers and between the platen roller and the heating means.

9. A method of conveying a sheet material, comprising:

providing a thermal activation device comprised of heating means for thermally activating a heat-sensitive adhesive layer of a sheet material having a printing layer on one surface of a sheet-like base material and the heat-sensitive adhesive layer on the other surface thereof, a platen roller that conveys the sheet material, the platen roller being disposed in pressure contact with the heating means so that the platen roller and the heating means apply a holding force on the sheet material, and a pair of conveyor rollers that hold and convey the sheet material, the pair of conveyor rollers being disposed on a downstream side of the heating means in a conveying direction of the sheet material; and conveying the sheet material in the conveying direction by the conveyor rollers and the platen roller so that the pair of conveyor rollers applies a greater holding force on the sheet material than a holding force applied on the sheet material by the platen roller and the heating means.

* * * * *